US005295704A

United States Patent [19]

Flock

[11] Patent Number: 5,295,704

[45] Date of Patent: Mar. 22, 1994

[54] SKI BINDING WITH KNEE FLEX SENSOR

[76] Inventor: Thomas P. Flock, R.R. 2, Box 135, Murphysboro, Ill. 62966

[21] Appl. No.: 898,181

[22] Filed: Jun. 12, 1992

Related U.S. Application Data

[63] Continuation of Ser. No. 623,233, Dec. 6, 1990, abandoned.

[51] Int. Cl.[5] ..... A63C 9/08

[52] U.S. Cl. ..... 280/611; 280/809

[58] Field of Search ..... 280/611, 612, 633, 634, 280/816, DIG. 13, 11.36, 809

[56] References Cited

U.S. PATENT DOCUMENTS

| | | | |
|---|---|---|---|
| 2,669,459 | 2/1954 | Fleming | 280/DIG. 13 |
| 3,528,672 | 9/1970 | Wunder | 280/612 |
| 3,776,566 | 12/1973 | Smolka | 380/612 |
| 3,909,028 | 9/1975 | Courvoisier et al. | 280/613 |
| 3,947,051 | 3/1976 | Sittman | 280/611 |
| 4,156,534 | 5/1979 | Salomon | 280/612 |
| 4,548,424 | 10/1985 | Spitaler | 280/612 |
| 4,563,021 | 1/1986 | Klubitschko | 380/612 |
| 4,640,026 | 2/1987 | Kirsch | 280/612 |

OTHER PUBLICATIONS

S. M. Maxwell et al., "Measurement of Strength and Loading Variables on the Knee During Alpine Skiing," *Seventh International Symposium on Skiing Trauma and Safety*, American Society for Testing and Materials, Philadelphia, Pennsylvania 1989.

*Primary Examiner*—Richard M. Camby
*Attorney, Agent, or Firm*—Philip L. Bateman

[57] ABSTRACT

An improved ski binding reduces the risk of knee injuries. The binding measures the angle of the knee flex of the skier with a sensor and used this measurement in making the retention/release decision. When the skier is in a position susceptible to knee injury, the release of the ski boot from the ski is caused or facilitated.

9 Claims, 1 Drawing Sheet

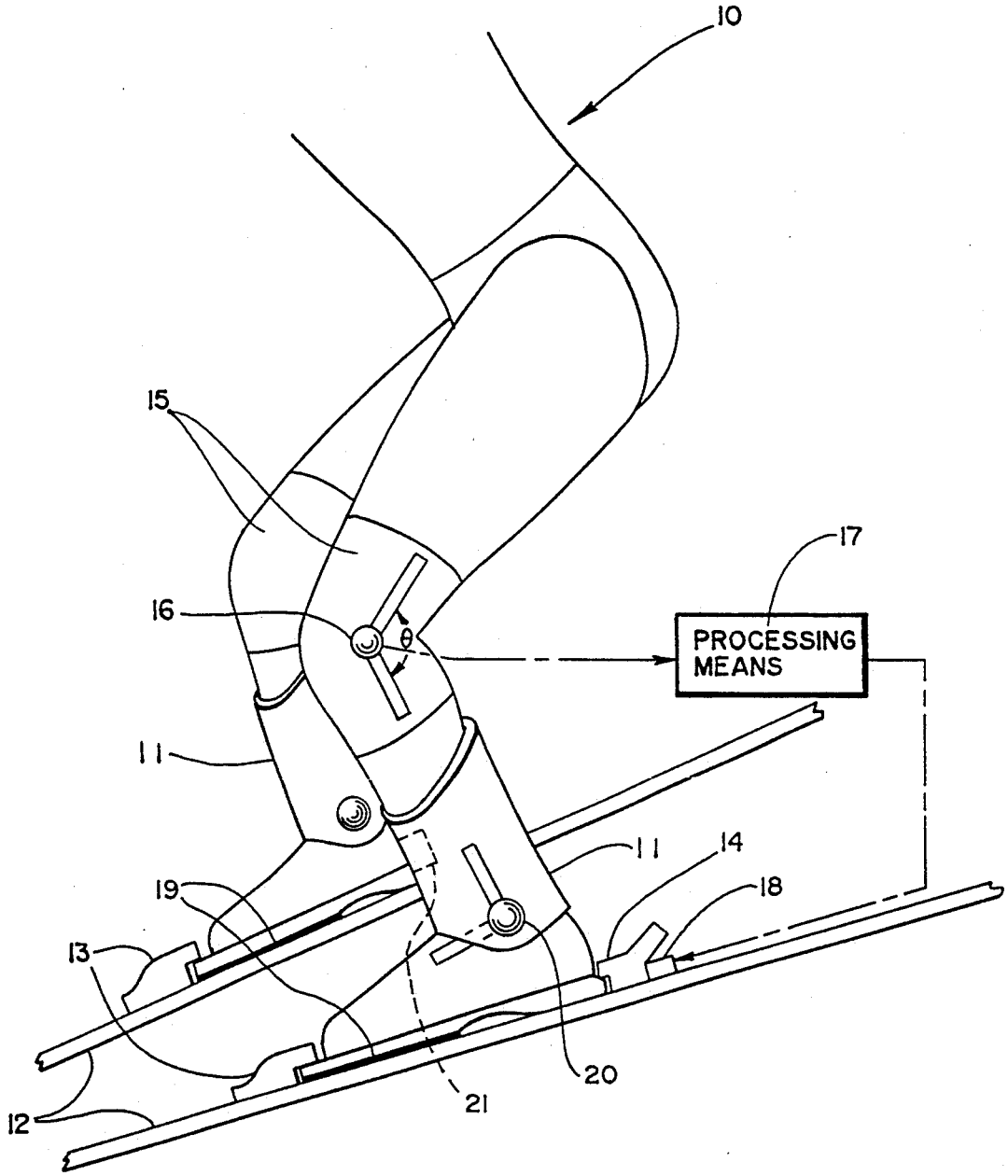
10
15
17
16
θ
PROCESSING MEANS
11
11
14
18
19
13
20
21
12

SKI BINDING WITH KNEE FLEX SENSOR

CROSS REFERENCE TO RELATED APPLICATION

This application is a continuation of U.S. patent application Ser. No. 07/623,233, filed Dec. 6, 1990, now abandoned.

FIELD OF THE INVENTION

This invention relates to snow ski bindings. More particularly, this invention relates to snow ski bindings which measure the angle of knee flex and cause or facilitate the release of the ski boot f rom the ski when the knee is in a position susceptible to injury.

BACKGROUND OF THE INVENTION

Downhill snow skiing (also known as alpine skiing) is a popular cold-weather outdoor sport requiring skill and proper equipment. Standard skiing equipment includes the skis themselves, ski boots, ski bindings, and ski poles. The ski bindings are mounted to the skis and are designed to hold the boot to the ski at most times, but to release the boot if it pulls away from the ski in such a way that an injury to the skier might occur. Conventional ski bindings contain spring-loaded jaws which are adjusted for tension according to the skiing conditions and the weight and skill of the skier. Conventional ski bindings are purely mechanical ana base their retention/release decision solely on the forces which develop between the boot and the binding.

The role of ski bindings in reducing the risk of injury during skiing has long been recognized. Within the past decade, it has also been found that the ski boot itself can play a major role in injury reduction. Older ski boots were relatively rigid and permitted little movement of the lower leg relative to the foot. As a result, many breaks of the tibia (the lower leg bone) occurred at a location corresponding to the top of the boot. Modern ski boots permit much more flex, especially forward flex. Many ski boots now contain separate leg and foot sections which are connected together with ankle pivots. The combination of modern ski bindings and improved ski boots has led to an 88 percent reduction in tibia fractures over a recent 15 year period. R. J. Johnson et al., "Skier Injury Trends," *Seventh International Symposium on Skiing Trauma and Safety*, American Society for Testing and Materials, Philadelphia, Pa. 1989.

Unfortunately, while tibia fractures and ankle sprains have been decreasing, serious knee injuries have shown a 2.7-fold increase. Knee injuries currently account for more than 20 percent of all alpine skiing injuries and the knee has become the most common injury site. It has been suggested that two major factors are responsible for the persistence of the knee injury rate: (1) Conventional ski bindings do not offer sufficient modes of release to protect the knee; and (2) The knee can become the weak link in the lower extremity because its strength varies as a function of the angle of knee flex. S. M. Maxwell et al., "Measurement of Strength and Loading Variables on the Knee During Alpine Skiing," *Seventh International Symposium on Skiing Trauma and Safety*, American Society for Testing and Materials, Philadelphia, Pa. 1989. More specifically, it is known that the knee is weakest when hyperflexed or fully extended and is strongest when bent slightly. When the knee is weakest, it is susceptible to serious injuries such as sprains or tears of the anterior cruciate ligament. Accordingly, S. M. Maxwell et al. suggest the desirability of a ski binding that incorporates some method of determining knee strength to satisfy release and retention requirements simultaneously.

Although there is no commercial ski binding available which bases its retention/release decision on knee strength, a number of ski bindings have been disclosed which employ electronics in the retention/release decision. For example, Smolka, U.S. Pat. No. 3,776,566, issued Dec. 4, 1973, discloses a ski binding containing sensors mounted onto the foot which pick up bio-electrical currents from muscle movements. When the currents reach a preselected value, the binding is automatically released. Courvoisier et al., U.S. Pat. No. 3,909,028, issued Sep. 30, 1975, discloses a ski binding having a sensor which detects twisting of the lower leg. Sittmann, U.S. Pat. No. 3,947,051, issued Mar. 30, 1976, discloses a ski binding having sensors on the foot which detect forces between the foot and the boot and cause the binding to release when these forces become excessive.

Accordingly, a need still exists for a ski binding which reduces the risk of knee injuries by basing its retention/release decision, at least in part, on knee strength.

SUMMARY OF THE INVENTION

The general object of this invention is to provide an improved snow ski binding. A more particular object is to provide a ski binding which reduces the risk of serious knee injury.

I have discovered a snow ski binding which comprises: (a) a releasable means of retaining a ski boot to a ski; (b) a means of measuring and transmitting the angle of the knee flex of the skier; (c) a processing means which receives the knee flex angle measurement and determines the knee's susceptibility to injury; and (d) a means of causing or facilitating the release of the ski boot from the ski when the knee is in a position susceptible to injury.

This invention reduces the risk of serious knee injury by causing or facilitating the release of the ski boot from the ski when the knee is in a position susceptible to injury, namely, either hyperflexed or fully extended.

BRIEF DESCRIPTION OF THE DRAWING

The drawing is a perspective view of a snow skier using an embodiment of the ski binding of this invention.

DETAILED DESCRIPTION OF THE INVENTION

This invention is beat understood by reference to the drawing. For ease of understanding, many of the components of the invention are shown schematically. The drawing shows a skier 10 wearing conventional ski boots 11 and skis 12. Mounted on the skis and holding the boots in place are front (toe) jaws 13 and rear (heel) jaws 14. The jaws can be manually opened to release the boot and can also be manually closed to retain the boot. The jaws are spring-loaded and release automatically if sufficient force is exerted between the boot and the binding to overcome the tension in the spring. A knee covering 15 is worn on each knee of the skier. Each knee covering contains a sensor 16 rotary potentiometer which measures the angle $\theta$ of the knee flex of the skier.

Each sensor transmits this measurement to a processing means represented as box 17. The processing means determines the knee's susceptibility to injury. When the processing means determines that the knee is in a position susceptible to injury, it sends a signal to an activator 18 which acts upon the jaws to either cause or facilitate the release of the ski boot from the ski.

This invention reduces the risk of serious knee injury by causing or facilitating the release of the ski boot from the ski when the knee is in a position susceptible to injury. It is known that the strength of the knee (and its resistance to injury) is a function of the angle of flex in the joint. The knee is most susceptible to injury when hyperflexed or fully extended. Skiers often inadvertently hyperflex their knees by losing their balance and falling straight back so that the skis are still flat on the snow but the skier is on his back rather than upright.

A simple and inexpensive means of measuring the knee flex angle is a rotary potentiometers, sometimes called a goniometer. A rotary potentiometer has a resistance to electrical current which is a function of the relative position of its two lever arms. As shown in the drawing, a rotary potentiometer is easily incorporated into a knee, covering worn by the skier. The knee covering is worn like a conventional knee pad and is easy for the skier to place into the proper orientation. Alternatively, a rotary potentiometer is mounted at the knee joint using straps on the thigh and calf held in place by elastic, velcro, or the like. Other suitable means of measuring knee flex include proximity sensors, pressure Sensors mounted on the back of the thigh and calf, and the like.

The information on the knee flex angle is transmitted to a processing means which then determines the knee's susceptibility to injury. As discussed earlier, the relationship between knee flex and susceptibility to injury is well documented. While a variety of means are suitable for making this determination, including analog circuitry and operational amplifiers, the preferred means is a microcontroller unit such as the M68HC11 Microcontroller, a commercial product of Motorola, Inc. This unit is described in detail in *The M*8HC11 Reference Manual (Prentice Hall, Englewood Cliffs, N.J. 1988). It is a high-density complementary metal-oxide semiconductor microcontroller containing read-only memory (ROM), electrically-erasable programmable read-only memory (E PROM), and random access memory (RAM). its small size, light weight, and durability enable it to be easily attached to the rear of the ski boot or other suitable location. Associated with the microcontroller are software, a power source (battery or solar), an on-off switch, and preferably a warning indicator (visual or aural) to warn the skier if the electronics are not operating for some reason.

When the processing means determines that the knee is in a position susceptible to injury, the release of the ski boot from the ski is caused or facilitated. A variety of means of accomplishing this result are available. For example, in one means, the processing means makes a decision to release if the knee flex angle exceeds a preselected value of extension or flex. Once this release decision is made, a signal is sent to a mechanical, hydraulic, or electrical activating component which, in turn, causes the opening of the jaws and the release of the ski boot. Such components are described in various sources, including Sittmann, U.S. Pat. No. 3,947,051, issued Mar. 30, 1976, which is incorporated by reference. On the other hand, as long as the knee flex angle does not exceed the preselected value, the processing means sends no signal and the jaws continue to function in a conventional manner and base their retention/-release decision on factors other than knee flex angle, namely, the forces between the boot and the binding. This means has the attractive feature that the knee sensor and processing means never hinder release. In other words, even if the electronics malfunction or lose power, the boot still releases as it would with a conventional binding.

A second means is to make use of the knee flex angle measurement to merely facilitate the release of the ski boot from the ski. For example, the release can be facilitated with conventional spring-loaded, variable-tension jaws by decreasing the tension. The tension decrease can be proportional to the movement of the knee away from its position of maximum strength (and least susceptibility to injury). Alternatively, the tension can be decreased to its minimal value when the knee flex angle exceeds a preselected value of extension or flex. In this way, some amount of force between the boot and the binding remains needed to trigger the release. A mechanism for automatically decreasing spring tension is disclosed in Spitaler, U.S. Pat. No. 4,548,424, issued Oct. 22, 1985, which is incorporated by reference. This type of hybrid electronic-mechanical system continues to offer the advantage that the mechanical release system continues to operate even if the electronic system malfunctions.

More sophisticated means feature inputs to the processing means in addition to the knee angle so that the retention/release decision can be based solely on electronics if so desired. Additional inputs are required for such a system because factors other than knee flex angle are of importance in making a retention/release decision which minimizes the risk of injury to any part of the skier's leg. In particular, input concerning the forces between the ski boot and the ski is needed. In the case of spring-loaded jaws, these forces can be determined by measuring the deformation (compression) of the spring with, for example, a potentiometer. These forces are also measurable directly with devices such as a dynamometer 19. Input concerning the ankle flex angle (the angle between the foot and the lower leg) is also important. Such input is obtainable by measuring the angle of boot flexion about the ankle pivots with, for example, a rotary potentiometer, and/or by measuring the pressure between the leg and the top of the ski boot. With a sensor 21 a microcontroller unit such as the Motorola M68HC11 has sufficient processing capabilities to receive all this information and to process it to determine if the skier is in a position susceptible to injury to any part of his leg, and to make the appropriate retention/-release decision.

I claim:

1. A snow ski binding which comprises:

(a) a releasable means for retaining a skier's ski boot to a ski;

(b) a means for measuring and transmitting the angle of the knee flex of the skier;

(c) a processing means which receives the knee flex angle measurement and uses the measurement in determining the knee's susceptibility to injury;

(d) a means for causing or facilitating the release of the ski boot from the ski when the knee is in a position susceptible to injury.

2. The snow ski binding of claim 1 wherein the means for measuring and transmitting the angle of knee flex comprises a rotary potentiometer.

3. The snow ski binding of claim 2 wherein the releasable means for retaining a ski boot to a ski comprises spring-loaded jaws which are adjustable for tension.

4. The snow ski binding of claim 3 wherein the means for causing or facilitating the release of the ski boot comprises reducing the tension on the spring-loaded jaws.

5. A snow ski binding which comprises:

(a) a releasable means for retaining a ski boot to a ski;

(b) a means for measuring and transmitting the angle of the knee flex of the skier;

(c) a means for measuring and transmitting at least one of the following:

(i) the angle of the ski boot flex;

(ii) the force between the ski boot and the foot; and (iii) the force between the ski boot and the ski;

(d) a processing means which, receives the measurements and the leg's susceptibility to injury; and (e) a means for causing or facilitating the release of the ski boot from the ski when the leg is in a position susceptible to injury.

6. The snow ski binding of claim 5 wherein the means for measuring and transmitting the angle of knee flex comprises a rotary potentiometer.

7. The snow ski binding of claim 6 wherein the releasable means for retaining a ski boot to a ski comprises spring-loaded jaws which are adjustable for tension.

8. The snow ski binding of claim 7 wherein the means of causing or facilitating the release of the ski boot comprises reducing the tension on the spring-loaded jaws.

9. The snow ski binding of claim 6 wherein the force between the ski boot and the ski is measured with a dynamometer.

* * * * *

UNITED STATES PATENT AND TRADEMARK OFFICE

CERTIFICATE OF CORRECTION

PATENT NO. : 5,295,704
DATED : March 22, 1994
INVENTOR(S) : Thomas P. Fiock

It is certified that error appears in the above-indentified patent and that said Letters Patent is hereby corrected as shown below:

On the title page under item [19] and item [76] please delete "Flock" and insert --Fiock--.

In the "Abstract" at line 3, "used" should be --uses--.

In col. 1, line 14, "f rom" should be --from--.

In col. 1, line 29, "ana" should be --and--.

In col. 2, line 55, "beat" should be --best--.

In col. 3, line 31, "Sensors" should be --sensors--.

Signed and Sealed this

Second Day of August, 1994

*Attest:*

Bruce Lehman

BRUCE LEHMAN

*Attesting Officer*

*Commissioner of Patents and Trademarks*